US008157473B2

(12) United States Patent
Johnson

(10) Patent No.: US 8,157,473 B2
(45) Date of Patent: Apr. 17, 2012

(54) APPARATUS AND METHOD FOR HIGHWAY MARKER REMOVAL

(75) Inventor: Steven C Johnson, Lebanon, IN (US)

(73) Assignee: M.A.S. Markers, Incorporated, Lebanon, IN (US)

( * ) Notice: Subject to any disclaimer, the term of this patent is extended or adjusted under 35 U.S.C. 154(b) by 336 days.

(21) Appl. No.: 12/428,695

(22) Filed: Apr. 23, 2009

(65) Prior Publication Data

US 2010/0270044 A1 Oct. 28, 2010

(51) Int. Cl.
*E01C 23/12* (2006.01)

(52) U.S. Cl. ..... 404/75; 404/94; 172/430; 33/264

(58) Field of Classification Search ..... 404/75, 404/94; 172/430; 299/36.1; 37/403; 33/264
See application file for complete search history.

(56) References Cited

U.S. PATENT DOCUMENTS

| | | | | | |
|---|---|---|---|---|---|
| 0,631,096 | A | | 8/1899 | Smith | |
| 1,706,256 | A | * | 3/1929 | Ronning et al. | 172/793 |
| 2,160,193 | A | * | 5/1939 | Arndt | 172/783 |
| 2,285,039 | A | | 6/1942 | Lowe | |
| 2,555,954 | A | * | 6/1951 | Brufiat | 33/264 |
| 2,783,698 | A | | 3/1957 | Bambi | |
| 2,845,192 | A | | 7/1958 | Klaus | |
| 3,153,866 | A | | 10/1964 | Bordeaux et al. | |
| 3,678,885 | A | * | 7/1972 | Ferguson | 33/370 |
| 4,331,206 | A | * | 5/1982 | Linton | 172/834 |
| 4,363,174 | A | * | 12/1982 | Curtis | 33/264 |
| 4,511,005 | A | * | 4/1985 | Brown | 172/430 |
| 4,545,439 | A | * | 10/1985 | Sellett et al. | 172/430 |
| 4,584,044 | A | | 4/1986 | Tokunaga et al. | |
| 4,624,601 | A | | 11/1986 | Quittner | |
| 4,650,005 | A | * | 3/1987 | Tebben | 172/430 |
| 5,027,906 | A | | 7/1991 | Jeannotte et al. | |
| 5,129,169 | A | | 7/1992 | Aubichon | |
| 5,172,499 | A | | 12/1992 | Griffin | |
| 5,297,351 | A | | 3/1994 | Cote | |
| 5,450,909 | A | * | 9/1995 | Stevenson | 172/430 |
| 5,471,770 | A | | 12/1995 | Ferreira | |
| 5,603,381 | A | | 2/1997 | Torgrimsen | |
| 5,603,382 | A | | 2/1997 | McIver | |
| 5,741,112 | A | | 4/1998 | Lakin et al. | |
| 6,619,755 | B1 | | 9/2003 | Christensen et al. | |
| 6,685,389 | B1 | | 2/2004 | Christensen et al. | |

* cited by examiner

*Primary Examiner* — Gary S Hartmann
(74) *Attorney, Agent, or Firm* — Barnes & Thornburg LLP

(57) ABSTRACT

An apparatus for removing markers from pavement includes a prime mover and an implement adjustably coupled to the prime mover. The implement includes a body, a tool having a working tip, a leveling pointer pivotably coupled to the body such that the leveling pointer moves relative to the body under the force of gravity, and a target indicium disposed near the leveling pointer. In some embodiments, the apparatus may further include a camera focused on the working tip of the tool and a display visible to an operator of the prime mover. A method of removing a marker from pavement includes positioning the working tip of a tool at a predetermined distance from an edge of the marker embedded in the pavement; adjusting the implement to a predetermined angle relative to an upper surface of the pavement by rotating the implement until the leveling pointer is aligned with the target indicium; and advancing the implement to remove the marker from the pavement.

20 Claims, 9 Drawing Sheets

APPARATUS AND METHOD FOR HIGHWAY MARKER REMOVAL

BACKGROUND OF THE INVENTION

The present disclosure is related to the removal of markers embedded in pavement. More specifically, the present disclosure is related to an implement and a method of using the implement to remove markers from pavement.

Markers may be embedded in pavement, such as the paved surface of a highway, a road, or a sidewalk. During construction, a portion of each marker may be placed below an upper surface of the pavement to secure the markers in a desired position, particularly in areas where snowplowing is frequent. Many markers include reflective lenses or sheeting disposed on one or more top surfaces that enhance visibility by reflecting automotive headlights. So that the reflective surfaces can receive light and the markers may otherwise been seen, the top surfaces of the marker are placed even with or above the upper surface of the pavement. Markers may be made with plastic, ceramic, and/or metal, and in a variety of shapes and colors. Particular colors are often placed along particular potions of the pavement to communicate information to drivers (e.g., white markers for lane dividers and yellow markers for medians or shoulders).

Over time, markers embedded in pavement are removed due to wear and tear, highway resurfacing, or for other reasons. Removal of a marker from the pavement necessitates removal of at least some of the pavement surrounding the marker that secures the marker in position during use. It is known in the art for a marker to be removed by disrupting pavement around the marker through use of a reciprocating impact hammer. A worker carries the reciprocating impact hammer to each marker to remove the marker.

SUMMARY OF THE INVENTION

The present application discloses one or more of the features recited in the appended claims and/or the following features which, alone or in any combination, may comprise patentable subject matter:

An implement for removing markers from pavement comprises a body and a tool mounted on the body. The tool includes a working tip which is operable to remove a marker from pavement. The implement further comprises a leveling pointer pivotably coupled to the body such that the leveling pointer moves relative to the body under the force of gravity. The implement still further comprises a target indicium disposed on the body near the leveling pointer. Alignment of the leveling pointer and the target indicium indicates that the working tip of the tool is positioned at a predetermined angle relative to the gravitational force.

In some embodiments, the body of the implement may include a leveling bracket. The leveling pointer may be pivotably coupled to the leveling bracket, and the target indicium may be disposed on the leveling bracket. The body may also include a shank having a hole formed therein, and the tool may be removably mounted on the body using a pin which passes through a pair of holes formed in the tool and the hole formed in the shank.

In some embodiments, the implement may further comprise a camera mounted to the body and focused on the working tip of the tool and a display in communication with the camera such that the display receives an image transmitted by the camera. In still other embodiments, the implement may further comprise a plurality of target indicia disposed on the body near the leveling pointer.

In another embodiment, the implement is adjustably coupled to a prime mover and positionable at a plurality of angles relative to the prime mover. Alignment of the leveling pointer of the implement, which points in the direction of the gravitational force, and the target indicium disposed near the leveling pointer indicates that the implement is positioned at a predetermined angle relative to the gravitational force.

In some embodiments, the prime mover may comprise a skid steer vehicle. A mounting plate may be adjustably coupled to the prime mover, and the implement may be releasably coupled to one of a plurality of mounting assemblies of the mounting plate. In still other embodiments, the prime mover may include a pair of loaders arms and an attachment bracket pivotably coupled to the loader arms, and the mounting plate may be releasably coupled to the attachment bracket. The prime mover may further include an actuator coupled to the loader arms and the attachment bracket. The actuator may be operable to position the implement at the plurality of angles relative to the prime mover.

In some embodiments, the prime mover may further include a display which receives image signals from the camera focused on the working tip of the tool. The display may be visible to an operator of the prime mover. The implement may further include a leveling bracket, and the target indicium may be disposed on the leveling bracket. The leveling pointer may be pivotably coupled to the leveling bracket such that the leveling pointer is visible to an operator of the prime mover.

A method of removing a marker from pavement comprises positioning an implement having a tool such that a working tip of the tool is a predetermined distance from an edge of a marker embedded in pavement, adjusting the implement to a predetermined angle relative to the gravitational force by rotating the implement until a leveling pointer which points in the direction of the gravitational force is aligned with a target indicium disposed near the leveling pointer, and advancing the implement to remove the marker from the pavement.

In some embodiments, the method may further comprise coupling the implement to one of a plurality of mounting assemblies on a mounting plate. The method may also include lowering the implement until the working tip contacts the upper surface of the pavement. In some embodiments, adjusting the implement to a predetermined angle may comprises determining the condition of the pavement securing the marker, choosing the angle of operation of the implement based on the condition of the pavement, identifying a particular target indicium from among a plurality of target indicium disposed near the leveling pointer corresponding to the angle of operation chosen, and rotating the implement until the leveling pointer is aligned with the particular target indicium. In still other embodiments, positioning the implement such that the working tip of the tool is a predetermined distance from the edge of the marker may include observing a position of the working tip of the tool relative to the edge of the marker with a camera, viewing the position on a display, and advancing the implement until the working tip of the tool is a predetermined distance from the edge of the marker.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
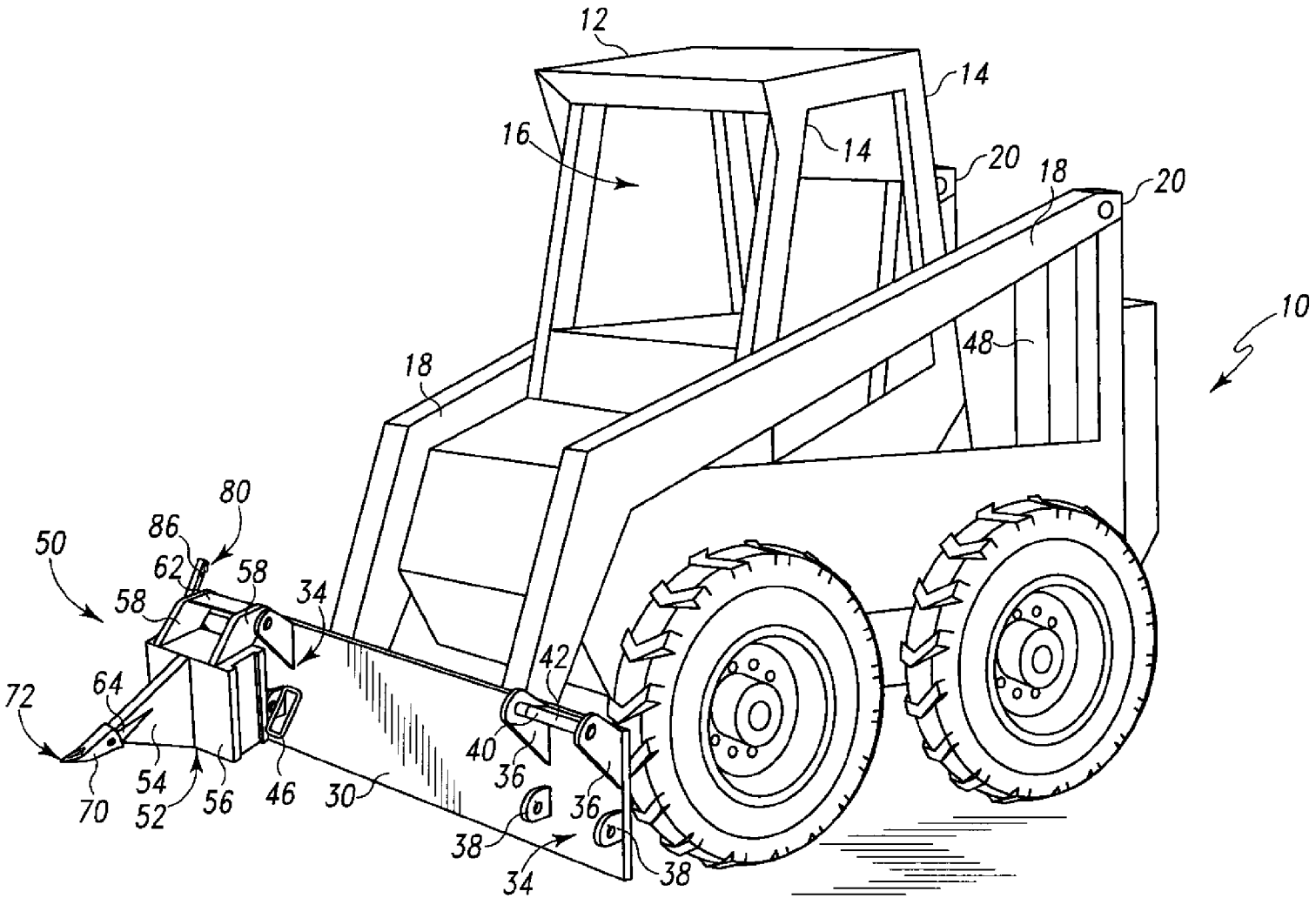
FIG. 1 is a perspective view of one embodiment of an apparatus including an implement for removing markers from pavement.
Figure 2:
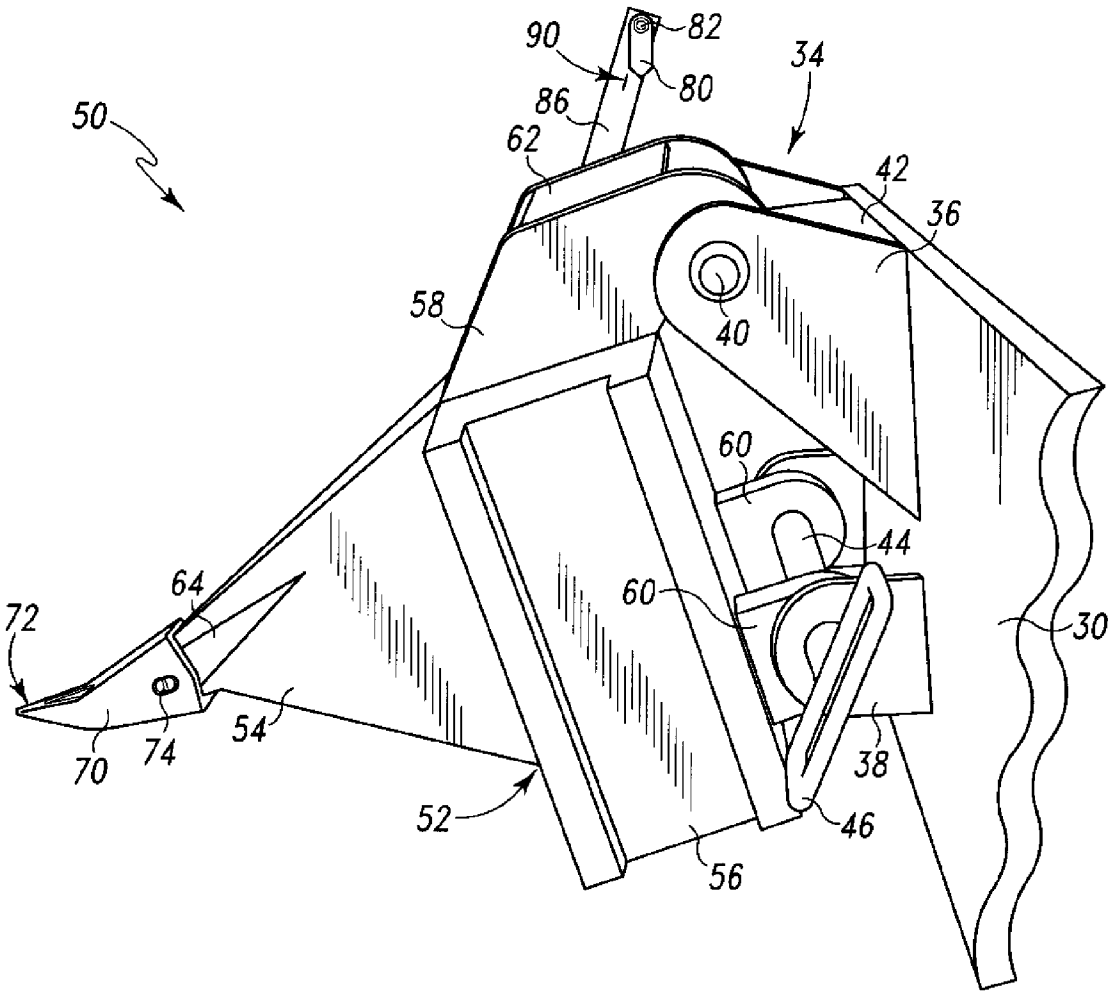
FIG. 2 is a perspective view of the implement of FIG. 1.
Figure 3:
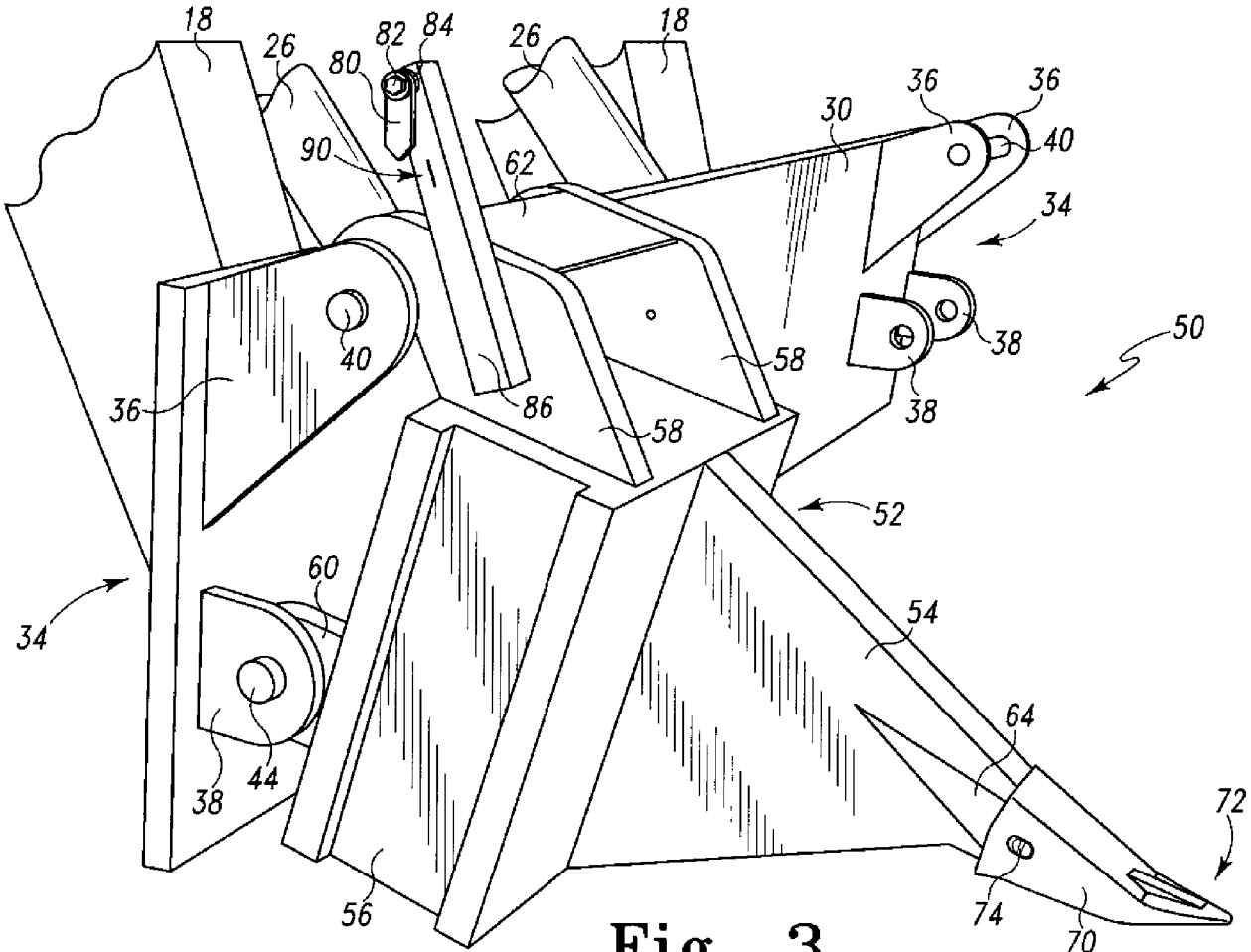
FIG. 3 is a perspective view of another embodiment of an implement for removing markers from pavement.

According to one illustrative embodiment, an apparatus for removing markers from pavement includes a prime mover 10 and an implement 50, as shown in FIG. 1. As will be described in more detail below, an operator may adjust the position of the implement 50 while viewing a leveling pointer 80 to adjust the implement 50 to a predetermined angle relative to the gravitational force. The operator may then advance the prime mover 10 and the implement 50 to remove a marker from the pavement surface. Various aspects of this and other illustrative embodiments according to the present disclosure may be seen in FIGS. 1-9. Throughout all figures, similar components are be labeled using similar reference numerals for clarity.

The prime mover 10 may embodied as any type of power-driven machinery or equipment capable of supporting and moving the implement 50. The prime mover 10 is illustratively embodied in FIG. 1 as a skid steer vehicle 10 having a roof 12 and a number of roof supports 14 which generally define a cab 16. During use, the operator occupies the cab 16 and manipulates various controls therein to operate the vehicle 10. The vehicle 10 further includes a pair of loader arms 18 that can be raised or lowered under power. The loader arms 18 are powered by a number of actuators 48, embodied as hydraulic or pneumatic cylinders. Each vehicle arm 18 is disposed on one side of the cab 16 and includes a rear end 20 pivotably coupled near the rear of the vehicle 10. The pair of loader arms 18 pivot about the rear ends 20 such that the forward ends of the loader arms 18 generally move in a vertical arc in front of the vehicle 10.

Figure 4:
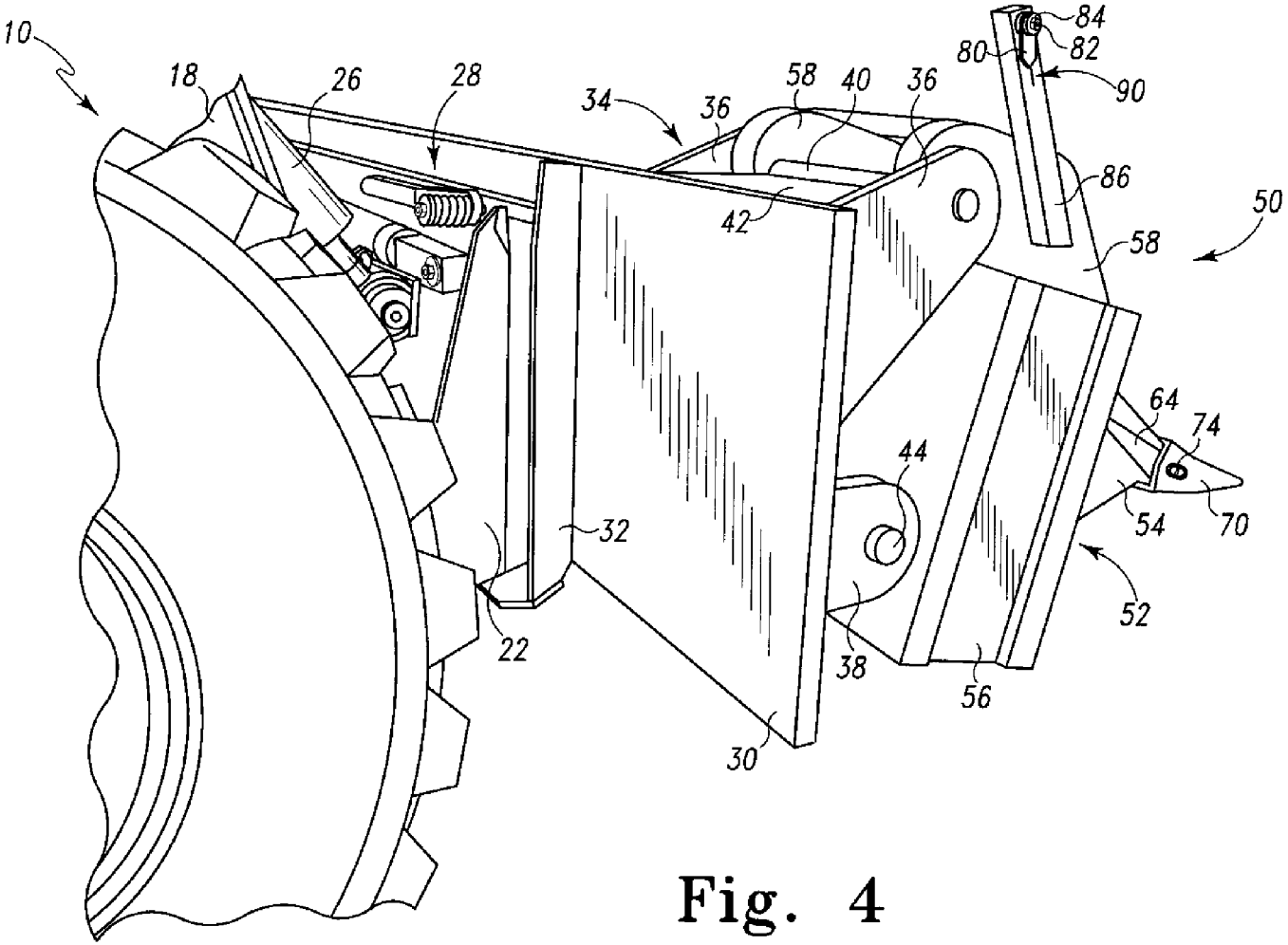
FIG. 4 is a perspective view of the implement of FIG. 3.
Figure 5:
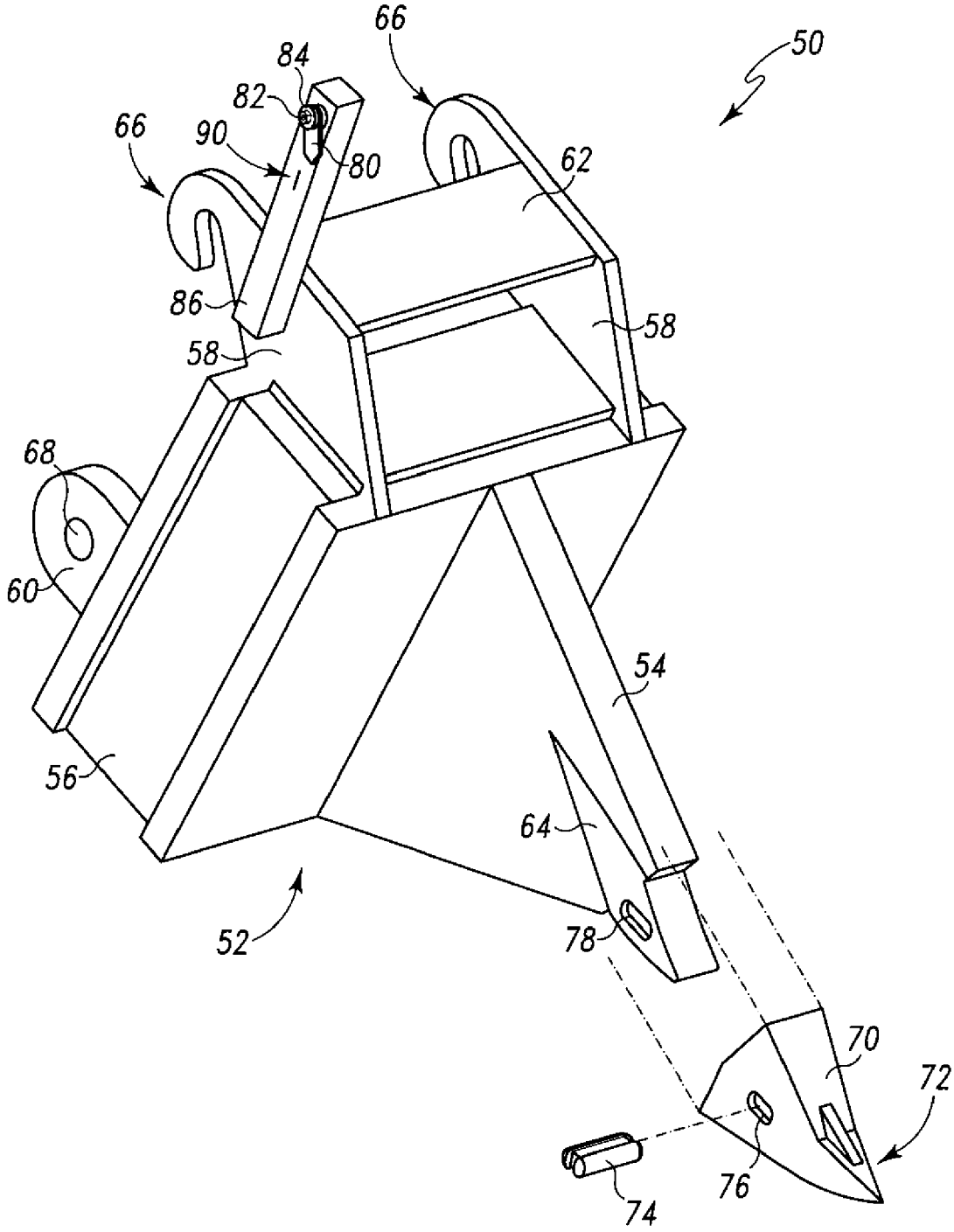
FIG. 5 is a partially exploded, perspective view of the implement of FIG. 3.
Figure 6:
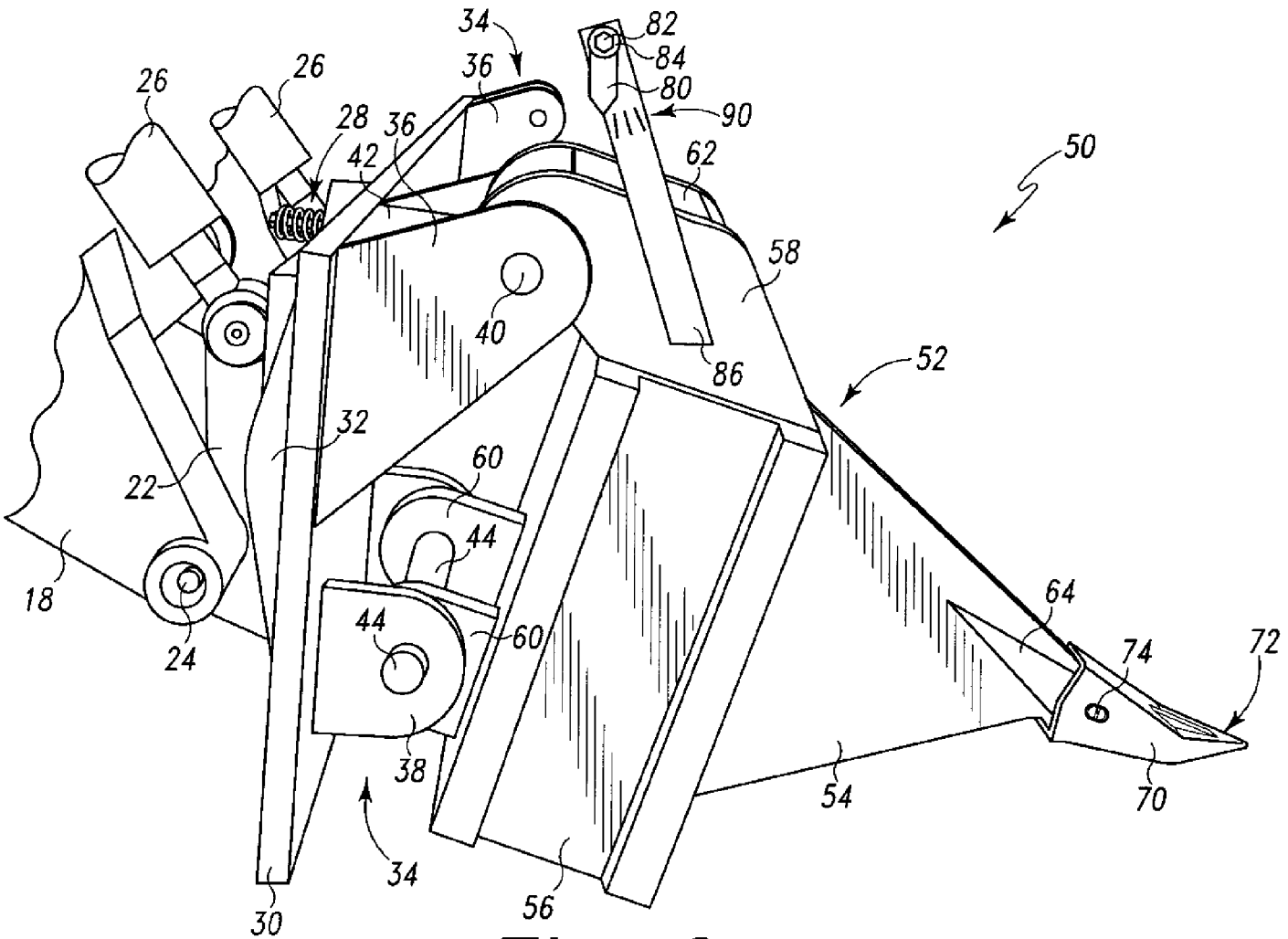
FIG. 6 is a perspective view of another embodiment of an implement for removing markers from pavement.

The forward ends of the loader arms 18 are pivotably coupled to an attachment bracket 22 at a horizontal pivot 24, which may be best seen in FIGS. 4 and 6. A number of actuators 26, embodied as hydraulic or pneumatic cylinders, are coupled to the attachment bracket 22 and are operable to rotate the attachment bracket 22 about the horizontal pivot 24. The attachment bracket 22 is provided with a latch assembly (indicated generally at 28). Such a bracket and latch assembly are known in the art and are used to allow various implements to be used with various skid steer vehicles such as the vehicle 10. The latch assembly 28 allows attachments to be releasably coupled to the attachment bracket 22 and, thus, the forward ends of the loader arms 18 for use with the vehicle 10. Using the latch assembly 28, one attachment may be released from the attachment bracket 22 and another attachment may be secured to the attachment bracket 22 in relatively little time.

A mounting plate 30 includes a mating assembly 32 configured to be received by the attachment bracket 22 of the vehicle 10. The mating assembly 32 is positioned on a rear side of the mounting plate 30 and allows the mounting plate 30 to be releasably coupled to the attachment bracket 22 via the latch assembly 28, as shown in the embodiments of FIGS. 1-4 and 6-8. When the mounting plate 30 is coupled to the attachment bracket 22, manipulation of the controls of the vehicle 10 allows the operator to rotate the mounting plate 30 about the horizontal pivot 24 using the actuators 26 and to raise and lower the mounting plate 30 using the loader arms 18 and the actuators 48. A front side of the mounting plate 30 includes at least one mounting assembly 34 to which an implement 50 is be releasably coupled. In some embodiments, such as the embodiment shown in FIG. 1, the mounting bracket 30 includes two mounting assemblies 34 (one mounting assembly 34 is shown without an implement 50).

Each mounting assembly 34 of the mounting plate 30 includes a pair of upper brackets 36 and a pair of lower brackets 38 which extend outwardly from the front side of the mounting plate 30. Each of the upper brackets 36 and lower brackets 38 includes a hole formed therein. An upper shaft 40 is disposed through the holes in the pair of upper brackets 36 and is pernanently fixed to the upper brackets 36, such as by welding. The upper shaft 40 is further supported by one or more support braces 42. A lower shaft 44 is placed through the holes in the pair of lower brackets 38 when an implement 50 is coupled to the mounting assembly 34, as will be described in more detail below. The lower shaft 44 includes a handle 46 at one end to assist in insertion and removal through the lower brackets 38.

The implement 50 includes a body 52, a tool 70 mounted on the body 52, and a leveling pointer 80 pivotably coupled to the body 52, as shown generally in FIG. 1 and in more detail in FIGS. 2-6. The body 52 of the implement 50 comprises a nose portion 54, a box portion 56, a pair of upper brackets 58, a pair of lower brackets 60, and, optionally, a camera mount plate 62 and/or a leveling bracket 82. The nose portion 54, the box portion 56, the upper brackets 58, the lower brackets 60, the camera mount plate 62, and the leveling bracket 82 are formed of metal and are permanently fixed to one another, such as by welding. The nose portion 54 has a generally triangular shape which extends outwardly from a front side of the box potion 56 and includes a shank 64 designed to receive the tool 70.

The upper brackets 58 of the implement 50 are secured to a top side of the box portion 56 and are configured to interface with the upper shaft 40 of the mounting assembly 34. Each upper bracket 58 of the implement 50 includes a hook portion 66 which engages the upper shaft 40 when the implement 50 is coupled to the mounting plate 30. The lower brackets 60 of the implement 50 extend outwardly from a rear side of the box portion 56 and are configured to interface with the lower brackets 38 and the lower shaft 44 of the mounting assembly 34. The lower shaft 44 is positioned in a hole 68 formed in each of the lower brackets 60, as well as the holes formed in the pair of lower brackets 38, when the implement 50 is coupled to the mounting plate 30. Once the implement 50 is thus secured to the mounting plate 30, which is in turn coupled to the attachment bracket 22, the operator of the vehicle 10 may control movement and positioning of the implement 50. Removal of the lower shaft 44 from the lower brackets 38 and the lower brackets 60 allows the implement 50 to be decoupled from the mounting plate 30.

The tool 70 is the portion the implement 50 which directly works on the pavement and removes a marker from the pavement. In some embodiments, the tool 70 is designed to be removable from the body 52 of the implement 50 so that the tool 70 is replaceable as needed. The tool 70 includes a working tip 72, which contacts and disrupts the pavement around a marker. The working tip 72 of the tool 70 is shown as pointed in the illustrative embodiments but may be differently shaped in other embodiments. As may be best seen in FIG. 5, the tool 70 is removably mounted to the body 52 by use of a pin 74. In the illustrative embodiment, the pin is a Pengo 2350 flex pin available from Pengo Corp. of Laurens, Iowa. In other embodiments, some other pins or retainers may be used to mount the removable tool 70 to the body 52. A cavity (not shown) extends inwardly from a rear side of the tool 70 and is configured to receive the shank 64 of the body 52. When the shank 64 engages the cavity of the tool 70, the pin 74 is inserted through a pair of holes 76 formed on the sides of the tool 70 and a hole 78 formed in the shank 64. The tool 70 is illustratively embodied as a forged bucket tooth commercially available from manufacturer Pengo Corp. of Laurens, Iowa, specifically, a Pengo Model 230T having a pointed working tip 72. The Pengo Model 230 is an illustrative example of a tool having a wedge-shaped working tip which may be used in other embodiments.

The leveling pointer 80 is pivotably coupled to the body 52 such that the leveling pointer 80 moves relative to the body 52 under the force of gravity. The leveling pointer 80 acts as a plumb member which points in the direction of the gravitational force, even as the remainder of the implement 50 rotates. In the illustrative embodiments shown in FIGS. 1-8, the body 52 of the implement 50 further comprises a leveling bracket 86 designed specifically to hold the leveling pointer 80. The leveling bracket 86 is embodied as a bar which is attached to a side of one of the upper brackets 58 and extends generally upwardly from the body 52. The leveling bracket 86 allows the leveling pointer 80 to reside generally above the remainder of the implement 50, such that the leveling pointer 80 can be seen by the operator in the cab 16 of the vehicle 10. The leveling pointer 80 is coupled to the leveling bracket 86 by a bolt 82 and bearings 84 and is free to move relative thereto. Persons having ordinary skill in the art will recognize that pivotably coupling the leveling pointer 80 to the body 52 for free movement may be accomplished through any of a number of structures. It is also contemplated that in other embodiments, the leveling pointer 80 may be coupled to other portions of the body 52 of the implement 50, such as the nose portion 54, the box portion 56, or one of the upper brackets 58.

In the illustrative embodiments of FIGS. 1-5, a target indicium 90 is a painted mark disposed on the same side of the leveling bracket 86 to which the leveling pointer 80 is pivotably coupled. The term "target indicium" as used herein means a discrete marking, sign, etching, engraving, or other type of discrete feature which is specifically positioned on a portion of the implement to provide a discrete reference for a user to align and maintain proper positioning of the implement to a predetermined angular position relative to gravity by comparing the position of the leveling pointer 80 to the target indicium 90. In some embodiments, the target indicium 90 may be disposed in other locations on the body 52 near the leveling pointer 80. In some embodiments, the target indicium 90 may be a symbol printed, painted, etched, or otherwise drawn on a portion of the body 52 or a symbol integrally formed as part of the body 52, such as a groove or ridge. During rotation of the implement 50, alignment of the leveling pointer 80 and the target indicium 90 indicates that the implement 50 (or the working tip 72 of the tool 70) is positioned at a predetermined angle relative to the gravitational force.

In other illustrative embodiments, such as that shown in FIG. 6, several target indicia 90 are disposed near the leveling pointer 80. Each of the plurality of target indicia 90 signifies a particular angle from among a plurality of predetermined angles between the implement 50 (or the working tip 72 of the tool 70) and the gravitational force. Such embodiments may be used when a plurality of predetermined angles are desired corresponding to multiple grades of pavement or to multiple styles of markers to be removed.

Figure 7:
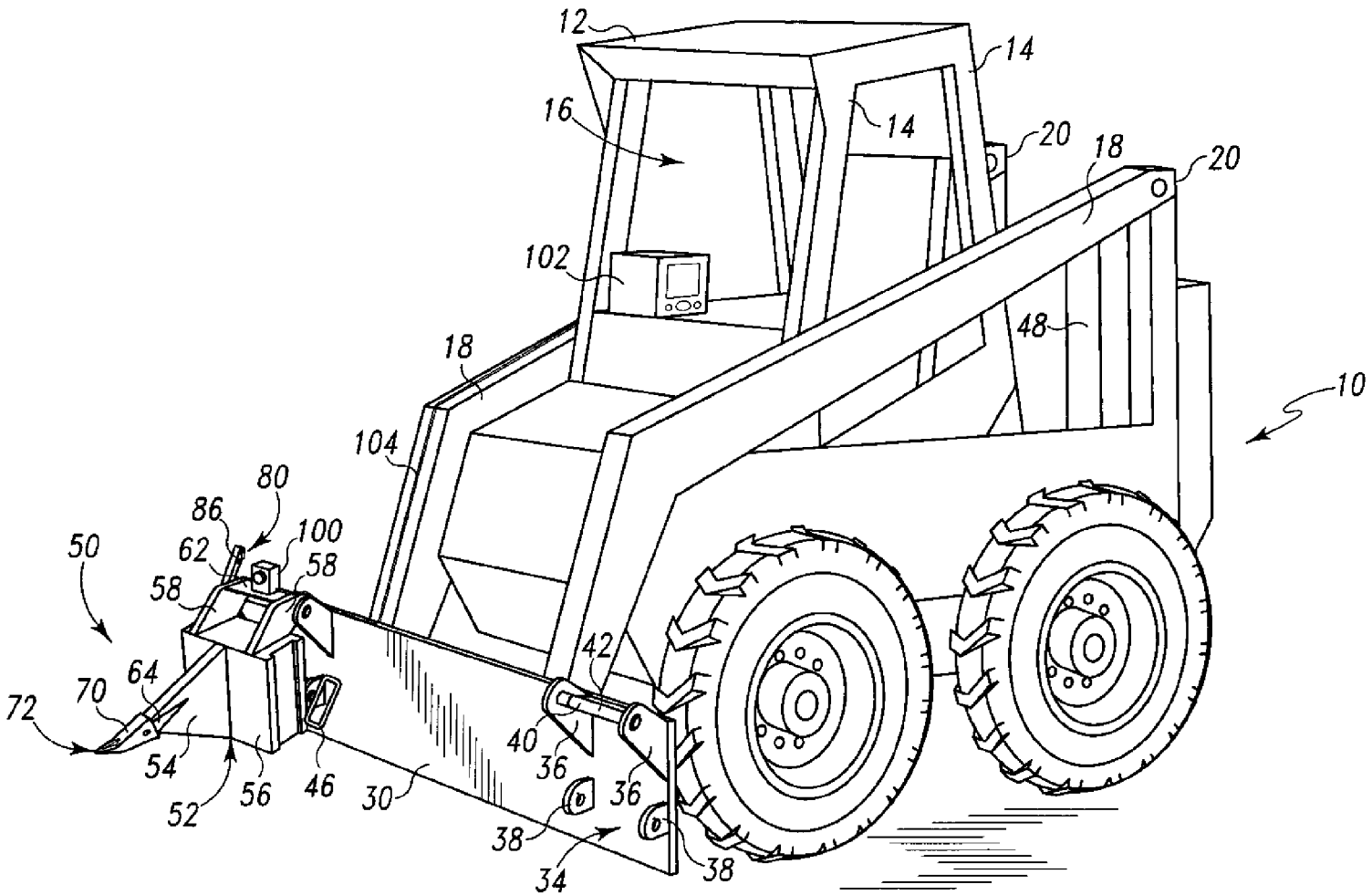
FIG. 7 is a perspective view of another embodiment of an apparatus including an implement for removing markers from pavement.
Figure 8:
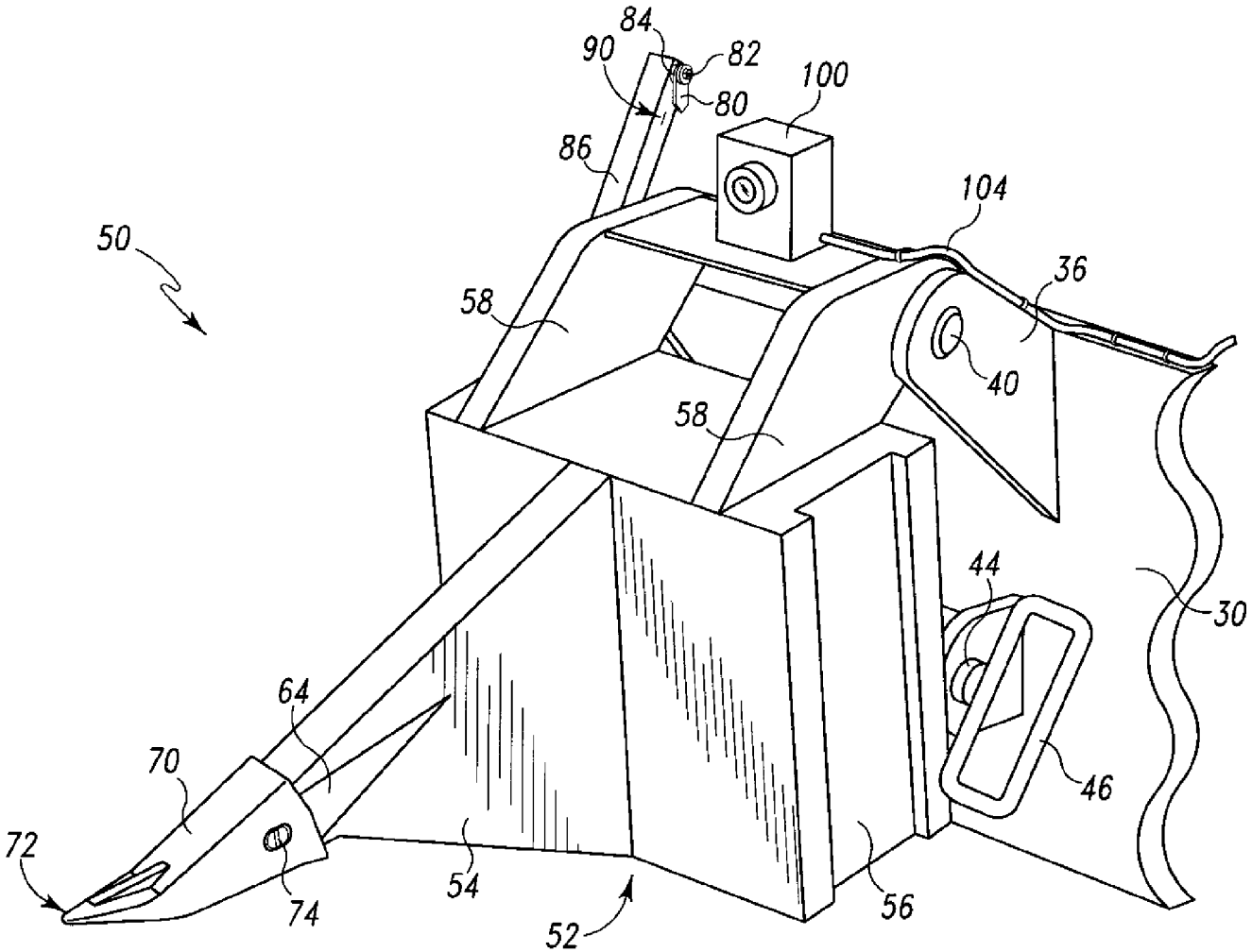
FIG. 8 is a perspective view of the implement of FIG. 7.

Referring now to FIGS. 7 and 8, another illustrative embodiment of an apparatus for removing markers from pavement is similar to the embodiment of FIGS. 1-6 and further includes a camera 100, a display 102, and associated wiring 104. The camera 100, which is illustratively embodied in FIGS. 7 and 8 as an electronic video camera 100, is secured to the camera mount plate 62 of the implement 50 and is generally focused on the tool 70 of the implement 50. The camera mount plate 62 is disposed between the upper brackets 58 to form a shelf or platform to support the camera 100. In other embodiments, the camera 100 may be secured to other portions of the body 52 of implement 50, such as the nose portion 54 or the box portion 56, or may be secured to the mounting plate 30 or the vehicle 10.

A display 102 provides the images captured by the camera 100 to the operator of the vehicle 10. The display 102 is illustratively embodied as compact television 102 mounted in the cab 16 near the controls of the vehicle 10, as shown in FIGS. 7 and 8. In other embodiments, the display 102 may be mounted in other positions in or around the cab 16 which are visible to the operator of the vehicle 10. The display 102 is connected to the camera 100 by wiring 104 which communicates electrical signals between the camera 100 and the display 102. The wiring 104 is secured to the mounting plate 30 and the vehicle 10. In the illustrative embodiment, the camera 100, display 102, and wiring 104 form a closed circuit television system which displays a live video feed from the camera 100 on the display 102. During use of the apparatus, the camera 100 and the display 102 allow the operator in the cab 16 of the vehicle 10 to view the position of the working tip 72 of the tool 70 in relation to objects in vicinity of the implement 50, such as markers embedded in pavement. While the illustrative embodiment is a wired system, in other embodiments the camera 100 may communicate images to the display 102 through wireless communications such as via a radio-frequency (F) signal, for example.

Figure 9:
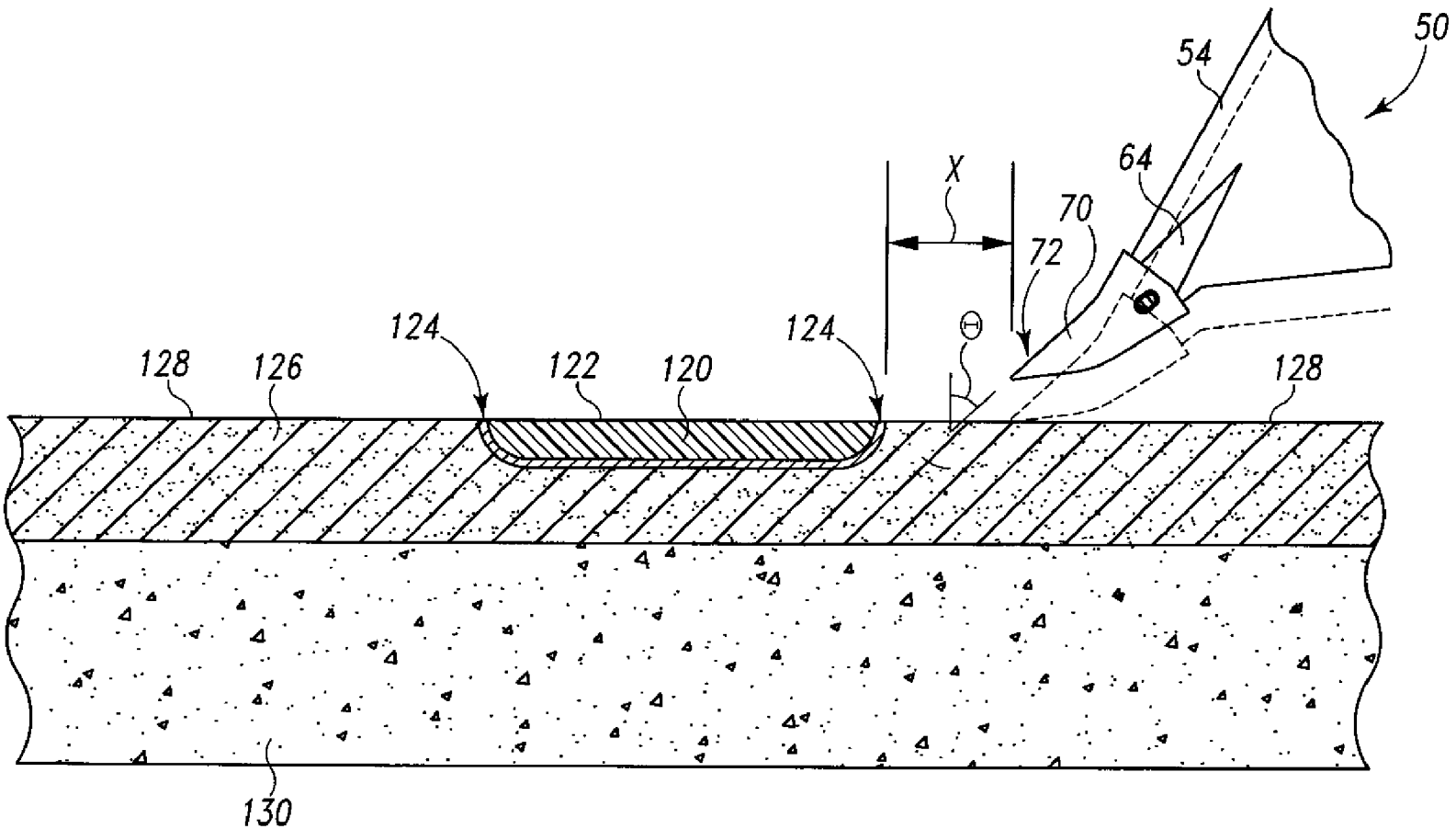
FIG. 9 is a cross sectional view of a marker embedded in pavement and an implement positioned to remove the marker.

An illustrative method of operating the apparatus described above to remove a marker from pavement will now be described. As shown in FIG. 9, the pavement 126 is disposed over a substrate 130, such as soil, and includes an upper surface 128 opposite the substrate 130. A marker 120 embedded in pavement 126 has a number of edges 124 which contact the pavement 126. A portion of each marker 120 is disposed below the upper surface 128 of the pavement 126. The marker 120 also includes a reflective top surface 122 which is flush with the upper surface 128 of the pavement 126. In other cases, the reflective top surface 122 of the marker 120 may be above the upper surface 128 of the pavement 126.

In preparation for the method of removing the marker 120 from the pavement 126, the mounting plate 30 is coupled to the attachment plate 22 of the vehicle 10 using the latch assembly 28, and the implement 50 is coupled to one of the mounting assemblies 34 of the mounting plate 30. As described above, the implement 50 is coupled to one of the mounting assemblies 34 by engaging the upper brackets 58 with the upper shaft 40 while the lower shaft 44 is positioned through the holes in the lower brackets 60 and the lower brackets 38. The implement 50 may be interchangeably mounted to one or the other mounting assembly 34, allowing the vehicle 10 to approach the marker 120 from either the right or the left.

The method of operating the apparatus to remove the marker 120 from the pavement 126 begins with bringing the apparatus toward the marker 120 such that the implement 50 is in the general proximity of the marker 120. At this point, the tool 70 of the implement 50 is kept a distance above the upper surface 128 of the pavement 126. The working tip 72 of the tool 70 is positioned at a predetermined distance X from the edge 124 of the marker 120. If the illustrative embodiment of the apparatus shown in FIGS. 7 and 8 is employed, the camera 100 observes the working tip 72 of the tool 70 and the area around the tool 70. In this embodiment, the operator may observe the distance between the working tip 70 and the edge 124 using the display 102 in the cab 16 of the vehicle 10 to properly position the working tip 72 of the tool 70.

After the working tip 72 of the tool 70 is positioned at the predetermined distance X from the edge 124 of the marker 120, the operator adjusts the angle between the implement 50 and the gravitational force to a predetermined angle θ. The operator adjusts the implement 50 by manipulating the controls of the vehicle 10 to rotate the attachment bracket 22 (and hence the mounting plate 30 and implement 50) about the horizontal pivot 24 using the actuators 26. As the implement 50 rotates, the leveling pointer 80 moves relative to the body 52 of the implement 50 under the force of gravity. The operator continues to adjust the implement until the leveling pointer 80 is aligned with the target indicium 90 on the leveling bracket 86. Alignment of the leveling pointer 80 and the target indicium 90 indicates that the working tip 72 of the tool 70 is positioned at the predetermined angle θ relative to the gravitational force. In other embodiments which include a plurality of marks 90 disposed near the leveling pointer 80, the operator chooses an appropriate angle of operation θ, identifies a particular target indicium 90 corresponding to the desired angle of operation θ, and adjusts the implement 50 until the leveling pointer 80 is aligned with the particular target indicium 90.

Once the working tip 72 of the tool 70 is positioned at the predetermined distance X from the edge 124 of the marker 120 and at the predetermined angle θ relative to the gravitational force, the operator lowers the implement 50 until the working tip 72 contacts the upper surface 128 of the pavement 126 (indicated in phantom in FIG. 9). The operator lowers the implement 50 by manipulating the controls of the vehicle 10 to lower the loader arms 18 (and hence the mounting plate 30 and implement 50) using the actuators 48. Finally, the operator advances the vehicle 10 and the implement 50, disrupting the pavement 126 around the marker 120 using the working tip 72 of the tool 70, thus removing the marker 120 from the pavement 126.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present invention and fall within the spirit and scope of the present disclosure as defined by the appended claims.

The invention claimed is:

1. An apparatus for removing markers from pavement, the apparatus comprising:

a prime mover; and an implement adjustably coupled to the prime mover and positionable at a plurality of angles relative to the prime mover, the implement including (i) a leveling pointer which points in the direction of the gravitational force and (ii) a target indicium, and (iii) a tool including a working tip, wherein alignment of the leveling pointer and the target indicium indicates that the working tip of the implement is positioned at a predetermined angle relative to the gravitational force.

2. The apparatus of claim 1, wherein the prime mover comprises a skid steer vehicle.

3. The apparatus of claim 1, further comprising a mounting plate adjustably coupled to the prime mover, the implement being releasably coupled to one of a plurality of mounting assemblies of the mounting plate.

4. The apparatus of claim 3, wherein:

the prime mover includes a pair of loaders arms and an attachment bracket pivotably coupled to the loader arms; and the mounting plate is releasably coupled to the attachment bracket.

5. The apparatus of claim 4, wherein the prime mover further includes an actuator coupled to the loader arms and the attachment bracket, the actuator operable to position the implement at the plurality of angles relative to the prime mover.

6. The apparatus of claim 1, wherein the implement further comprises a body and a tool mounted on the body, the tool including a working tip.

7. The apparatus of claim 6, further comprising:

a camera having a field of view which includes the working tip of the tool; and a display which receives image signals from the camera, the display visible to an operator of the prime mover.

8. The apparatus of claim 1, wherein:

the implement further includes a leveling bracket;

the target indicium is disposed on the leveling bracket; and the leveling pointer is pivotably coupled to the leveling bracket such that the leveling pointer is visible to an operator of the prime mover.

9. An implement for removing markers from pavement, the implement comprising:

a body;

a tool mounted on the body, the tool including a working tip which is operable to remove a marker from pavement;

a leveling pointer pivotably coupled to the body such that the leveling pointer moves relative to the body under the force of gravity; and a target indicium disposed on the body near the leveling pointer, wherein alignment of the leveling pointer and the target indicium indicates that the working tip of the tool is positioned at a predetermined angle relative to the gravitational force.

10. The implement of claim 9, wherein:

the body of the implement includes a leveling bracket;

the leveling pointer is pivotably coupled to the leveling bracket; and the target indicium is disposed on the leveling bracket.

11. The implement of claim 9, wherein:

the body includes a shank having a hole formed therein; and the tool is removably mounted on the body using a pin which passes through a pair of holes formed in the tool and the hole formed in the shank.

12. The implement of claim 9, further comprising:

a camera mounted to the body such that the field of view of the camera includes the working tip of the tool: and a display in communication with the camera such that the display receives an image transmitted by the camera.

13. The implement of claim 9, further comprising a plurality of indicia disposed on the body near the leveling pointer, each of the plurality of indicia corresponding to a predetermined operating angle of the implement.

14. A method of removing a marker from pavement, the method comprising:

positioning an implement having a tool such that a working tip of the tool is a predetermined distance from an edge of a marker embedded in pavement, the implement including (i) a leveling pointer which points in the direction of the gravitational force and (ii) a target indicium disposed near the leveling pointer;

adjusting the implement to a predetermined angle relative to the gravitational force by rotating the implement until the leveling pointer is aligned with the target indicium; and advancing the implement to remove the marker from the pavement.

15. The method of claim 14, further comprising coupling the implement to one of a plurality of mounting assemblies on a mounting plate.

16. The method of claim 14, further comprising lowering the implement until the working tip contacts the upper surface of the pavement.

17. The method of claim 14, wherein adjusting the implement to a predetermined angle comprises:

determining the condition of the pavement securing the marker;

choosing the angle of operation of the implement based on the condition of the pavement;

identifying a particular target indicium from among a plurality of indicia disposed near the leveling pointer, the particular target indicium corresponding to the angle of operation chosen; and rotating the implement until the leveling pointer is aligned with the particular target indicium.

18. The method of claim 17, further comprising lowering the implement until the working tip contacts the upper surface of the pavement.

19. The method of claim 18, wherein positioning the implement such that the working tip of the tool is a predetermined distance from the edge of the marker comprises:

observing a position of the working tip of the tool relative to the edge of the marker with a camera;

viewing the position on a display; and advancing the implement until the working tip of the tool is a predetermined distance from the edge of the marker.

20. The method of claim 14, wherein positioning the implement such that the working tip of the tool is a predetermined distance from the edge of the marker comprises:

observing a position of the working tip of the tool relative to the edge of the marker with a camera;

viewing the position on a display; and advancing the implement until the working tip of the tool is a predetermined distance from the edge of the marker.

* * * * *